US007900764B2

(12) United States Patent
Dickover et al.

(10) Patent No.: US 7,900,764 B2
(45) Date of Patent: Mar. 8, 2011

(54) LATCHING AND SECURING MECHANISM FOR BILL PRESENTER OF A CURRENCY DISPENSING MACHINE

(75) Inventors: Wesley D. Dickover, Stuart, FL (US); Dean F. Herring, Youngsville, NC (US); Philip M. Woodward, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 381 days.

(21) Appl. No.: 12/038,136

(22) Filed: Feb. 27, 2008

(65) Prior Publication Data

US 2009/0211875 A1 Aug. 27, 2009

(51) Int. Cl.
*G07F 7/04* (2006.01)
*G07F 9/10* (2006.01)

(52) U.S. Cl. ..... 194/206; 194/350

(58) Field of Classification Search ..... 194/206, 194/250, 350; 209/534
See application file for complete search history.

(56) References Cited

U.S. PATENT DOCUMENTS 3,880,320 A 4/1975 Morello et al.
5,740,897 A * 4/1998 Gauselmann ..... 194/206
6,244,504 B1 6/2001 Holland-Letz
6,293,540 B1 9/2001 Kovacs
6,659,452 B2 * 12/2003 Abe et al. ..... 271/181
7,165,767 B2 1/2007 Graef et al.

FOREIGN PATENT DOCUMENTS

EP 0180358 10/1985
GB 2171394 A 2/1985

* cited by examiner

*Primary Examiner* — Stefanos Karmis
*Assistant Examiner* — Mark J Beauchaine
(74) *Attorney, Agent, or Firm* — Cantor Colburn LLP; Thomas Tyson

(57) ABSTRACT

A currency dispensing machine including a cabinet and a bill presenter located therein. The bill presenter includes a presenter having two side plates and at least one drive gear having a plurality of drive teeth. The bill presenter is located in a bill presenter housing having a mounting face, two retention plates extending from the mounting face and receivable of the presenter therebetween, and a longitudinally extending retention hook disposed in each of the two side plates. Two retaining pins are each insertable through one of the two retention hooks and through one of the retention plates. Two latch arms are slidably located in the bill presenter, each at one of the retention plates, and include a latch hook engageable with one of the retaining pins. The currency dispensing machine includes a bill dispenser slidably disposed in the cabinet and including a plurality of gear teeth engageable with the plurality of drive teeth and at least one locking slot. At least one locking pin is insertable into one of the at least one locking slot for preventing misalignment of the plurality of gear teeth with the plurality of drive teeth.

4 Claims, 4 Drawing Sheets

LATCHING AND SECURING MECHANISM FOR BILL PRESENTER OF A CURRENCY DISPENSING MACHINE

TRADEMARKS

IBM® is a registered trademark of International Business Machines Corporation, Armonk, N.Y., U.S.A. Other names used herein may be registered trademarks, trademarks or product names of International Business Machines Corporation or other companies.

BACKGROUND OF THE INVENTION

1. Field of the Invention

This invention relates to currency dispensing machines, and particularly to mechanisms for securing components of currency dispensing machines.

2. Description of Background

Currency dispensing machines include automated banking machines and the like. The currency dispensing machines typically include one or more bill dispensers often located in a housing or cabinet. Often the bill dispenser is disposed on one or more sliding rails which allow for easy insertion of the bill dispenser into the cabinet and is held in place in the cabinet by one or more spring-loaded pins.

A bill presenter is a component of currency dispensing machine which guides currency from the currency dispensing machine and presents the currency into a cup for customer retrieval. The bill presenter assembly is mounted in the cabinet and includes a bill presenter gear which is configured and located to mesh with a drive gear on the bill dispenser when the bill dispenser is inserted into the cabinet via the sliding rails. Upon insertion, however, the drive gear and the bill presenter gear are misaligned, preventing the currency dispensing machine from functioning correctly. Further, the bill presenter may become dislodged during insertion of the bill dispenser due to collision between the drive gear and the bill presenter gear.

SUMMARY OF THE INVENTION

The shortcomings of the prior art are overcome and additional advantages are provided through the provision of a currency dispensing machine including a cabinet and a bill presenter located therein. The bill presenter includes a presenter having two side plates, at least one drive gear having a plurality of drive teeth, and at least one presenter belt in operable communication with the at least one drive belt for urging currency through the dispenser. The bill presenter is located in a bill presenter housing having a mounting face, two retention plates extending from the mounting face and receivable of the presenter therebetween, and a longitudinally extending retention hook disposed in each side plate of the two side plates. Two retaining pins are each insertable through one retention hook of the two retention hooks and through one retention plate of the two retention plates. Two latch arms are slidably located in the bill presenter, each at one retention plate of the two retention plates, and include a latch hook engageable with one retaining pin of the two retaining pins for preventing longitudinal movement of the presenter relative to the bill presenter housing.

The currency dispensing machine includes a bill dispenser slidably disposed in the cabinet and including a plurality of gear teeth engageable with the plurality of drive teeth and at least one locking slot. At least one locking pin is insertable into one locking slot of the at least one locking slot for preventing misalignment of the plurality of gear teeth with the plurality of drive teeth.

Additional features and advantages are realized through the techniques of the present invention. Other embodiments and aspects of the invention are described in detail herein and are considered a part of the claimed invention. For a better understanding of the invention with advantages and features, refer to the description and to the drawings.

TECHNICAL EFFECTS

As a result of the summarized invention, technically we have achieved a solution which properly aligns a currency dispenser to a bill presenter in a currency dispensing machine, preventing malfunction of the currency dispensing machine.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

Figure 1:
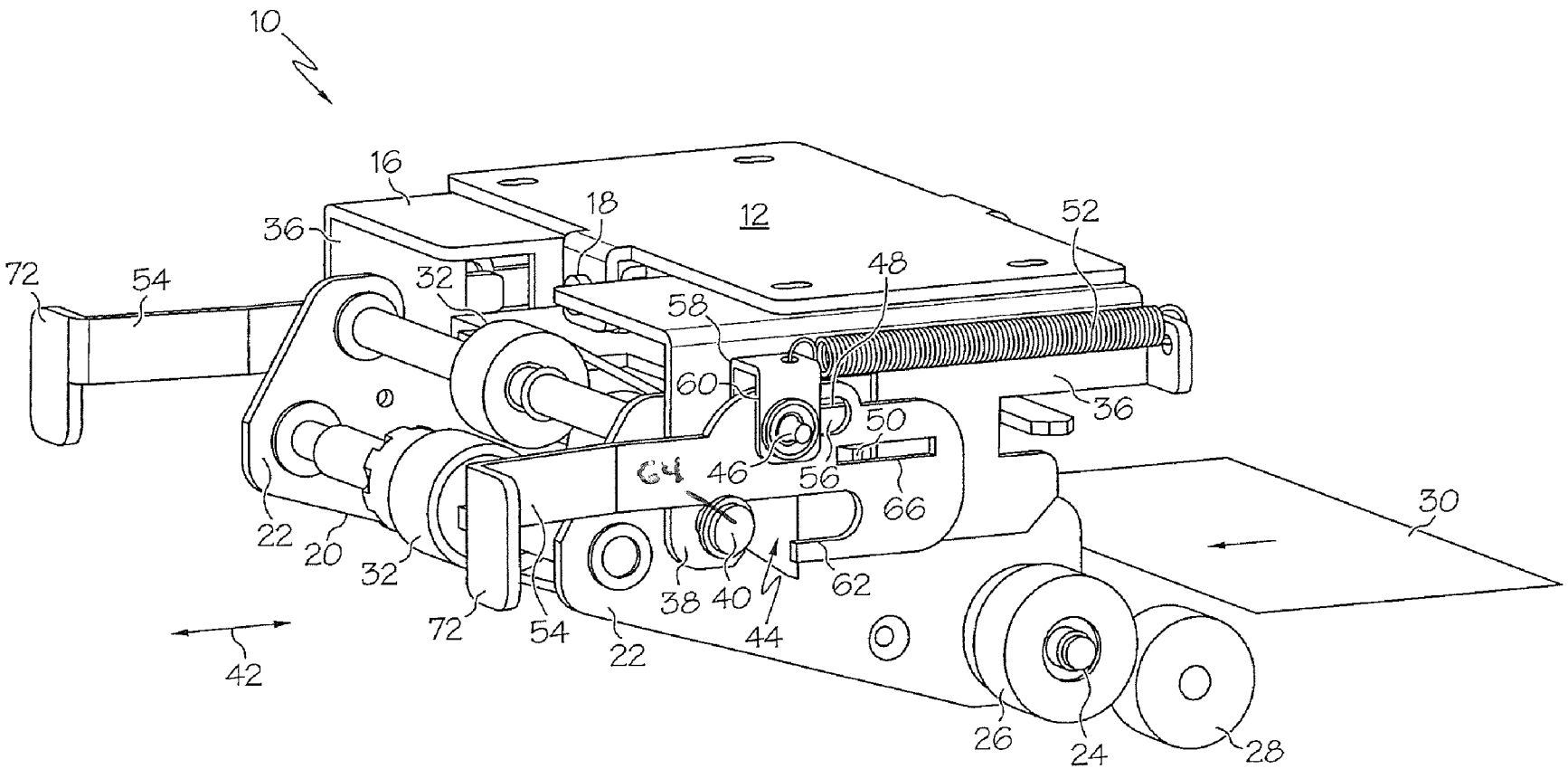
FIG. 1 is a perspective view of an embodiment of a bill presenter assembly.
Figure 2:
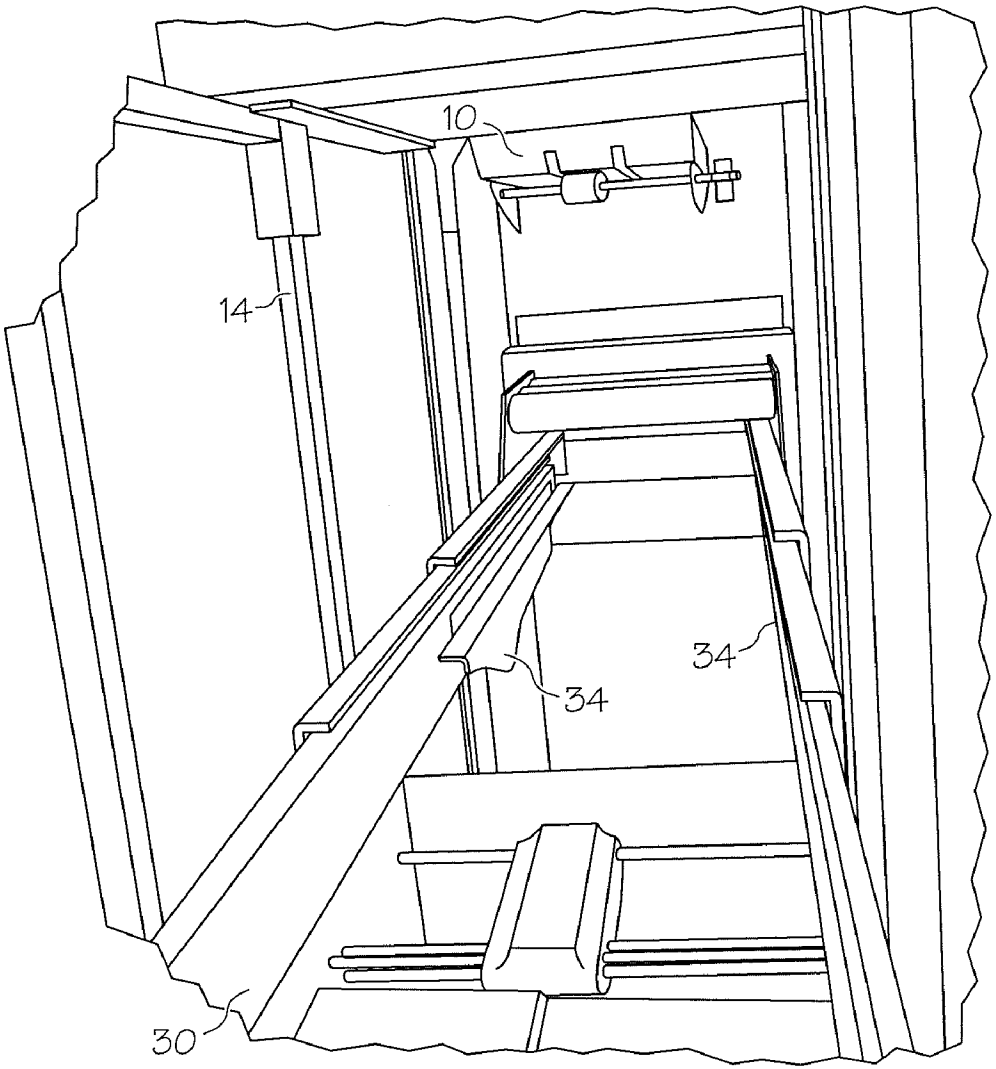
FIG. 2 is a partial view of a currency dispensing machine.

Turning now to the drawings in greater detail, it will be seen that in FIG. 1 there is a perspective view of a bill presenter assembly 10 for a currency dispensing machine. The bill presenter assembly 10 includes a mounting plate 12 for affixing the bill presenter assembly 10 to a cabinet 14, as best shown in FIG. 2. Returning to FIG. 1, the mounting plate 12 is affixed to a bill presenter housing 16 by, for example, two mounting screws 18. A presenter 20 is disposed at least partially within the bill presenter housing 16. The presenter 20 includes two side plates 22 and at least one drive gear 24 rotably disposed in at least one of the side plates 22. The at least one drive gear 24 includes a plurality of drive teeth 26 which mesh with gear teeth 28 of a dispenser 30 to drive the presenter 20. The drive gear 24 is operably connected to at least one presenter belt 32. Two presenter belts 32 are shown in the embodiment of FIG. 1, but it is to be appreciated that other quantities of presenter belts 32 are contemplated within the present scope. The presenter belts 32 are disposed and configured to urge currency from the dispenser 30 through the presenter 20 and into a cup (not shown).

The presenter 20 is secured in the bill presenter housing 16 to allow motion of presenter 20 relative to the bill presenter housing 16 to enable the drive teeth 26 to mesh with the gear teeth 28 when the dispenser 30 is installed into the cabinet 14 by, for example sliding the dispenser 30 along one or more installation rails 34 as shown in FIG.2. Referring again to FIG. 1, the bill presenter housing 16 includes two retention plates 36 disposed substantially parallel to the side plates 22 and are configured to receive the side plates 22 therebetween. It is to be appreciated that the structure at each retention plate 36 is the same, thus for simplicity of explanation only the structure at one of the retention plates 36 will be described herein. Each retention plate 36 includes a retaining hook 38 receivable of a retaining pin 40 which is inserted through the retaining hook 38 and into a retaining hole (not shown). The retaining pin 40 is retained in a longitudinal direction 42 by a bracket 44. The bracket 44 is rotably secured to the retention plate 36 by a mechanical fastener, for example a bolt 46. To prevent over rotation of the bracket 44, the bracket 44 includes a bracket arm 48 which interferes with an anti-rotation tab 50 in the event that the bracket 44 rotates to a limit in the clockwise direction. The bracket 44 is further connected to the bill presenter housing 16 via a spring 52. The spring 52 is configured to return the bracket 44 to a preferred orientation, vertical in the case of the embodiment shown in FIG. 1, when the bracket 44 is rotated.

A latch arm 54 is disposed at each retention plate 36. The latch arm 54 includes a latch arm slot 56 through which the bolt 46 is inserted thus securing the latch arm 54 to the retention plate 36. In the embodiment shown in FIG. 1, the latch arm 54 is disposed between a first arm 58 and a second arm 60 of the bracket 44. The latch arm slot 56 extends in the longitudinal direction 42 so that the latch arm 54 is slidable in the longitudinal direction 42. The latch arm 54 includes a latch hook 62 which is configured to be receivable of a head 64 of the retaining pin 40. When the latch arm 54 is moved to a latched position, the latch arm 54 engages the retaining pin 40 preventing motion of the presenter 20 and preventing inadvertent removal of the retaining pin 40 from the side plate 22.

In some embodiments, the latch arm 54 may include an alignment slot 66 which is configured and disposed to be receivable of the anti-rotation tab 50. Inclusion of the alignment slot 66 prevents rotation of the latch arm 54 so the latch hook 62 is more easily engageable with the retaining pin 40. Further, the latch may include a latch handle 72 allowing for easier engagement or disengagement of the latch arm 54 by a user. The handle 72 shown in FIG. 1 extends substantially perpendicular to the latch arm 54, but other configurations of handles 72 are contemplated within the present scope.

Figure 3:
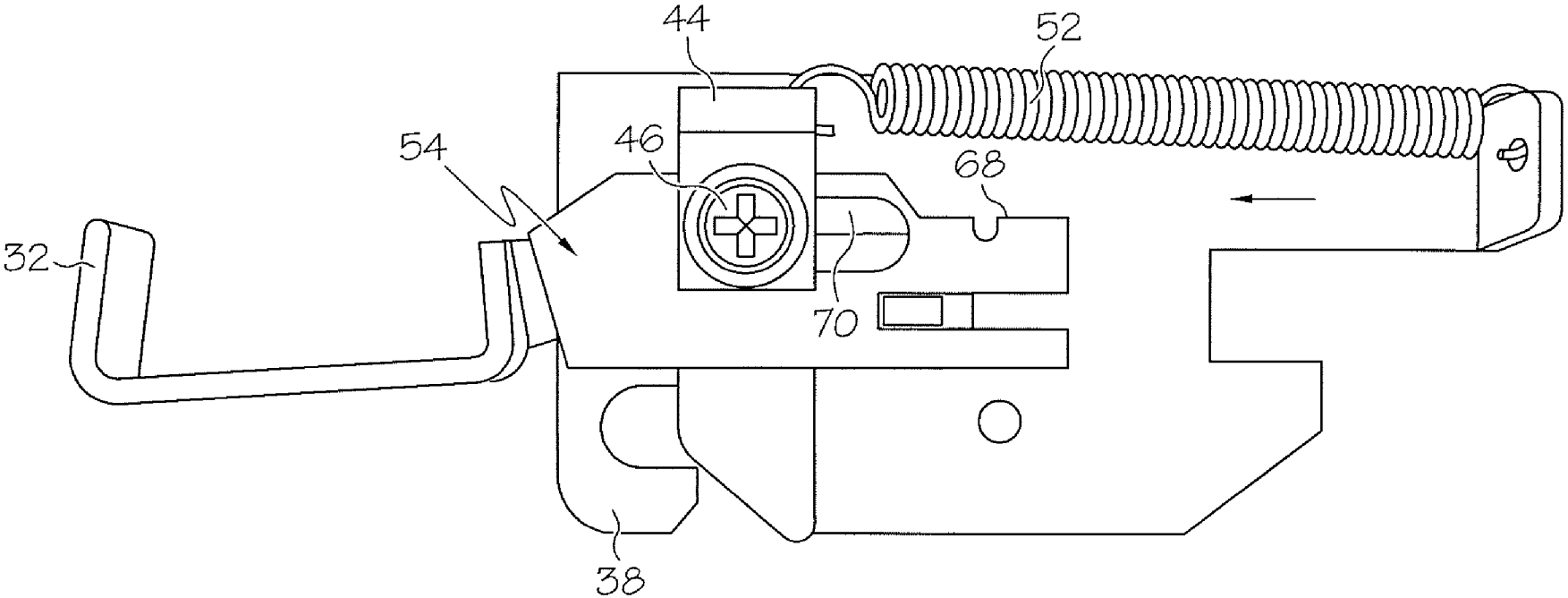
FIG. 3 illustrates an embodiment of a latch arm.

In some embodiments, as shown in FIG. 3, the latch arm 54 includes a locking tab 68 extending toward the bracket arm 48. The locking tab 68 is disposed at a bracket edge 70 to prevent rotation of the bracket 44 in a counterclockwise direction when the latch arm 54 is disposed in the engaged position. Thus, when the latch 54 is in the engaged position, the bracket 44 is prevented from rotating in the clockwise direction by the anti-rotation tab 50 and in the counterclockwise direction by the locking tab 68.

Figure 4:
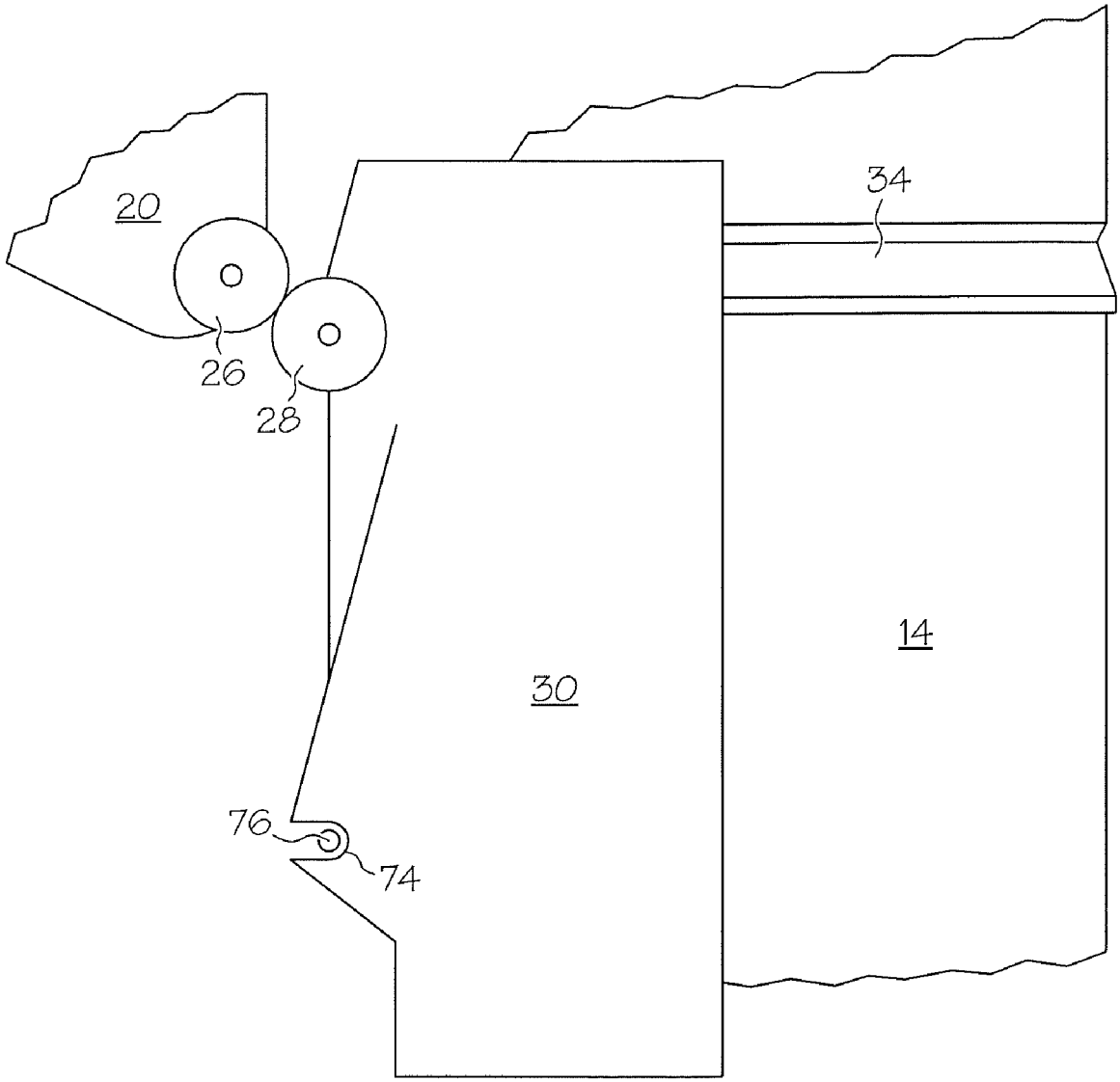
FIG. 4 illustrates an embodiment of a locking tab.

In some embodiments, as shown in FIG. 4, at least one locking slot 74 is included in the dispenser 30. Each locking slot 74 is configured and disposed to be receivable of a locking pin 76, which in some embodiments is spring loaded, disposed in the cabinet 14. When the dispenser 30 is inserted into the cabinet 14 to a position where the drive teeth 26 are engageable with the gear teeth 28, each locking slot 74 receives each locking pin 76 and prevents rotation of the dispenser 30 in the cabinet 14. Utilization of the latch 54 alone or together with the locking slot 74 and locking pin 76 prevents misalignment of dispenser 30 relative to the presenter 20 to ensure proper engagement of the gear teeth 28 with the drive teeth 26. Proper engagement of the gear teeth 28 to the drive teeth 26 ensures proper function of the currency dispensing machine and reduces downtime and the need for costly service calls to repair malfunctioning currency dispensing machines.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A currency dispensing machine comprising:

a cabinet including one or more slide rails;

a bill presenter disposed in the cabinet, the bill presenter including:

a presenter including:

two side plates;

at least one drive gear having a plurality of drive teeth; and at least one presenter belt in operable communication with the at least one drive belt for urging currency through the dispenser;

a bill presenter housing including:

a mounting face;

two retention plates extending from the mounting face and receivable of the presenter therebetween; and a longitudinally extending retention hook disposed in each side plate of the two side plates;

two retaining pins, each retaining pin insertable through one retention hook of the two retention hooks and through one retention plate of the two retention plates; and two latch arms, each latch arm slidably disposed at one retention plate of the two retention plates and including a latch hook engageable with one retaining pin of the two retaining pins for preventing longitudinal movement of the presenter relative to the bill presenter housing;

a bill dispenser slideably disposed in the cabinet, the bill dispenser including:

a plurality of gear teeth engageable with the plurality of drive teeth; and at least one locking slot; and at least one locking pin, each locking pin insertable into one locking slot of the at least one locking slot for preventing misalignment of the plurality of gear teeth with the plurality of drive teeth.

2. The currency dispensing machine of claim 1 including two spring loaded brackets, each spring loaded bracket in operable communication with one retention plate of the two retention plates and configured to allow rotation of the presenter in the bill presenter housing about an axis of the two retaining pins.

3. The currency dispensing machine of claim 1 wherein each retention plate of the two retention plates includes an anti-rotation tab insertable into an alignment slot in each latch arm of the two latch arms.

4. The currency dispensing machine of claim 1 wherein each latch arm of the two latch arms includes a latch arm handle.

* * * * *